US006974277B2

(12) United States Patent
Lutz et al.

(10) Patent No.: US 6,974,277 B2
(45) Date of Patent: Dec. 13, 2005

(54) DYNAMICALLY BALANCED WALK BEHIND TROWEL

(75) Inventors: Todd J. Lutz, Oconomowoc, WI (US); Gregory Kruepke, Waukesha, WI (US); Darrin W. Dauffenbach, Pewaukee, WI (US); Richard D. Goldberg, Hartford, WI (US)

(73) Assignee: Wacker Corporation, Menomonee Falls, WI (US)

( * ) Notice: Subject to any disclaimer, the term of this patent is extended or adjusted under 35 U.S.C. 154(b) by 0 days.

(21) Appl. No.: 10/704,105

(22) Filed: Nov. 7, 2003

(65) Prior Publication Data

US 2005/0100404 A1 May 12, 2005

(51) Int. Cl.[7] ..... E01C 19/22
(52) U.S. Cl. ..... 404/112
(58) Field of Search ..... 404/112

(56) References Cited

U.S. PATENT DOCUMENTS 2,942,536 A 6/1960 Irwin
4,232,980 A * 11/1980 Tertinek et al. ..... 404/112
4,320,986 A 3/1982 Morrison
4,629,359 A 12/1986 Sengupta
5,009,547 A 4/1991 Clark
5,372,452 A * 12/1994 Hodgson ..... 404/112

* cited by examiner

*Primary Examiner*—Gary S. Hartmann
(74) *Attorney, Agent, or Firm*—Boyle Fredrickson Newholm Stein & Gratz S.C.

(57) ABSTRACT

A walk behind rotary trowel is configured to be "dynamically balanced" so as to minimize the forces/torque that the operator must endure to control and guide the trowel. Characteristics that are accounted for by this design include, but are not limited to, friction, engine torque, machine center of gravity, and guide handle position. As a result, dynamic balancing and consequent force/torque reduction were found to result when the machine's center of gravity was shifted substantially relative to a typical machine's center of gravity. Dynamic balancing can be achieved most practically by reversing the orientation of the engine relative to the guide handle assembly when compared to traditional walk behind rotary trowels and shifting the engine as far as practical to the right. This shifting has been found to reduce the operational forces and torque the operator must endure by at least 50% when compared to traditional machines.

18 Claims, 5 Drawing Sheets

DYNAMICALLY BALANCED WALK BEHIND TROWEL

BACKGROUND OF THE INVENTION

1. Field of the Invention

The invention relates to concrete finishing trowels and, more particularly, relates to a walk-behind rotary concrete finishing trowel which is dynamically balanced to reduce operator effort. The invention additionally relates to a method of operating such a trowel.

2. Discussion of the Related Art

Walk behind trowels are generally known for the finishing of concrete surfaces. A walk behind trowel generally includes a rotor formed from a plurality of trowel blades that rest on the ground. The rotor is driven by a motor mounted on a frame or "cage" that overlies the rotor. The trowel is controlled by an operator via a handle extending several feet from the cage. The rotating trowel blades provide a very effective machine for finishing mid-size and large concrete slabs. However, walk behind trowels have some drawbacks.

For instance, the rotating blades impose substantial forces/torque on the cage that must be counteracted by the operator through the handle. Specifically, blade rotation imposes a torque on the cage and handle that tends to drive the handle to rotate counterclockwise or to the operator's right. In addition, blade rotation tends to push the entire machine linearly, principally backwards, requiring the operator to push forward on the handle to counteract those forces. The combined torque/forces endured by the operator are substantial and tend to increase with the dynamic coefficient of friction encountered by the rotating blades which, in turn, varies with the "wetness" of curing concrete. Counteracting these forces can be extremely fatiguing, particularly considering the fact that the machine is typically operated for several hours at a time.

The inventors investigated techniques for reducing the reaction forces/torque that must be endured by the operator. They theorized that these forces would be reduced if the trowel were better statically balanced than is now typically the case with walk behind trowels, in which the center of gravity is located slightly behind and to the left of the rotor's axis of rotation. The inventors therefore theorized that shifting the trowel's center of gravity forwardly would reduce reaction forces. However, they found that this shifting actually led to an increase in reaction forces generated during trowel operation.

The need therefore has arisen to provide a walk behind rotary trowel that requires substantially less operator effort to steer and control than conventional walk behind trowels.

The need additionally has arisen to reduce the operator effort required to steer and control a walk behind rotary trowel.

SUMMARY OF THE INVENTION

Pursuant to the invention, a walk behind rotary trowel is configured to be better "dynamically balanced" so as to minimize the forces/torque that the operator must endure to control and guide the trowel. The design takes into account both static and dynamic operation and attributes of the trowel, and "balances" these attributes with the operational characteristics of concrete finishing. Characteristics that are accounted for by this design include, but are not limited to, friction, engine torque, machine center of gravity, and guide handle position. As a result, dynamic balancing and consequent force/torque reduction were found to result when the machine's center of gravity was shifted substantially relative to a typical machine's center of gravity. This effect can be achieved most practically by reversing the orientation of the engine relative to the guide handle assembly when compared to traditional walk behind rotary trowels and shifting the engine as far as practical to the right. This shifting has been found to reduce the operational forces and torque the operator must endure by at least 50% when compared to traditional machines. Operator fatigue therefore is substantially reduced.

These and other advantages and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE PREFERRED EMBODIMENTS

1. Construction of Trowel

Figure 1:
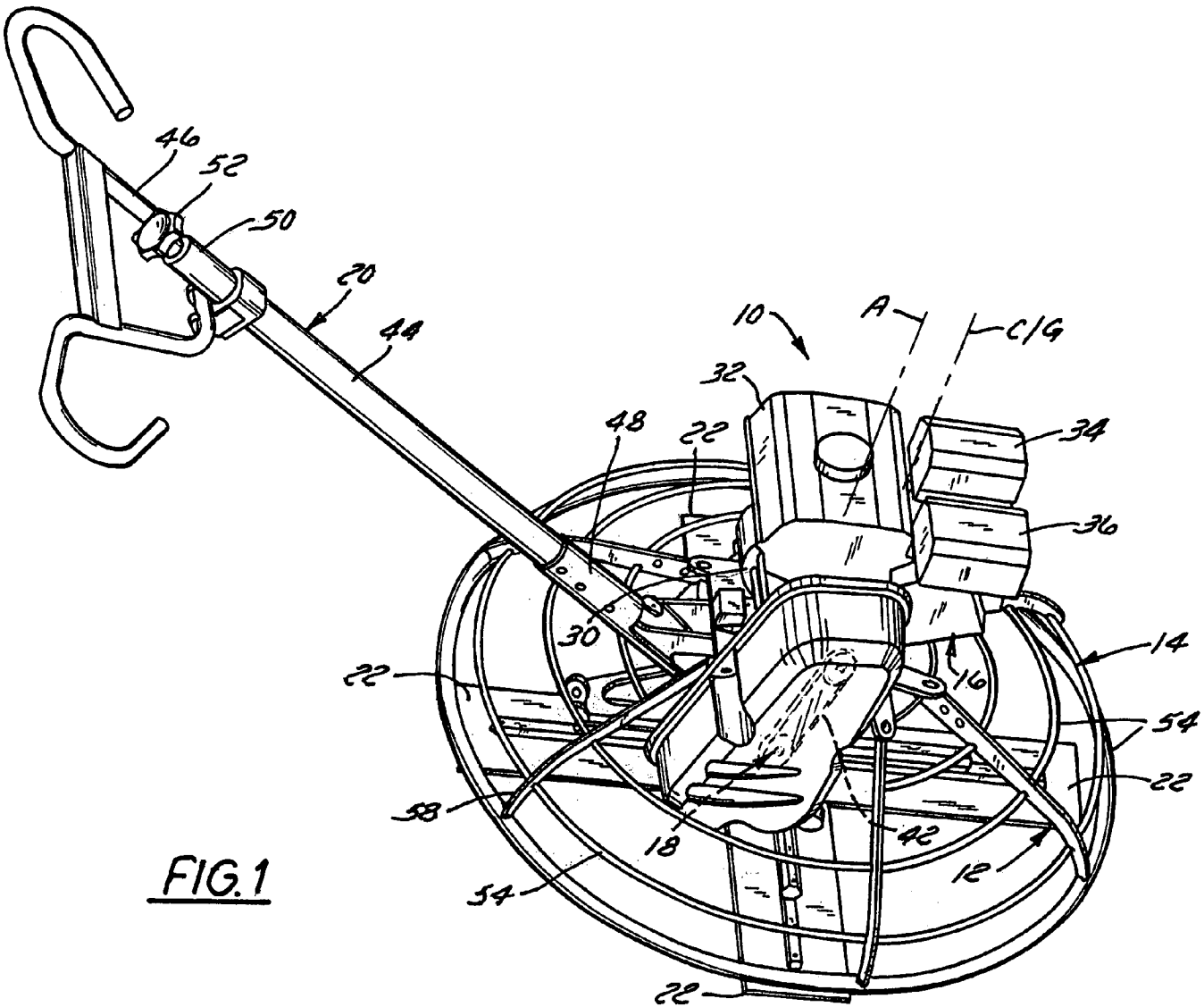
FIG. 1 is a perspective view of a walk-behind rotary trowel constructed in accordance with a preferred embodiment of the present invention.
Figure 2:
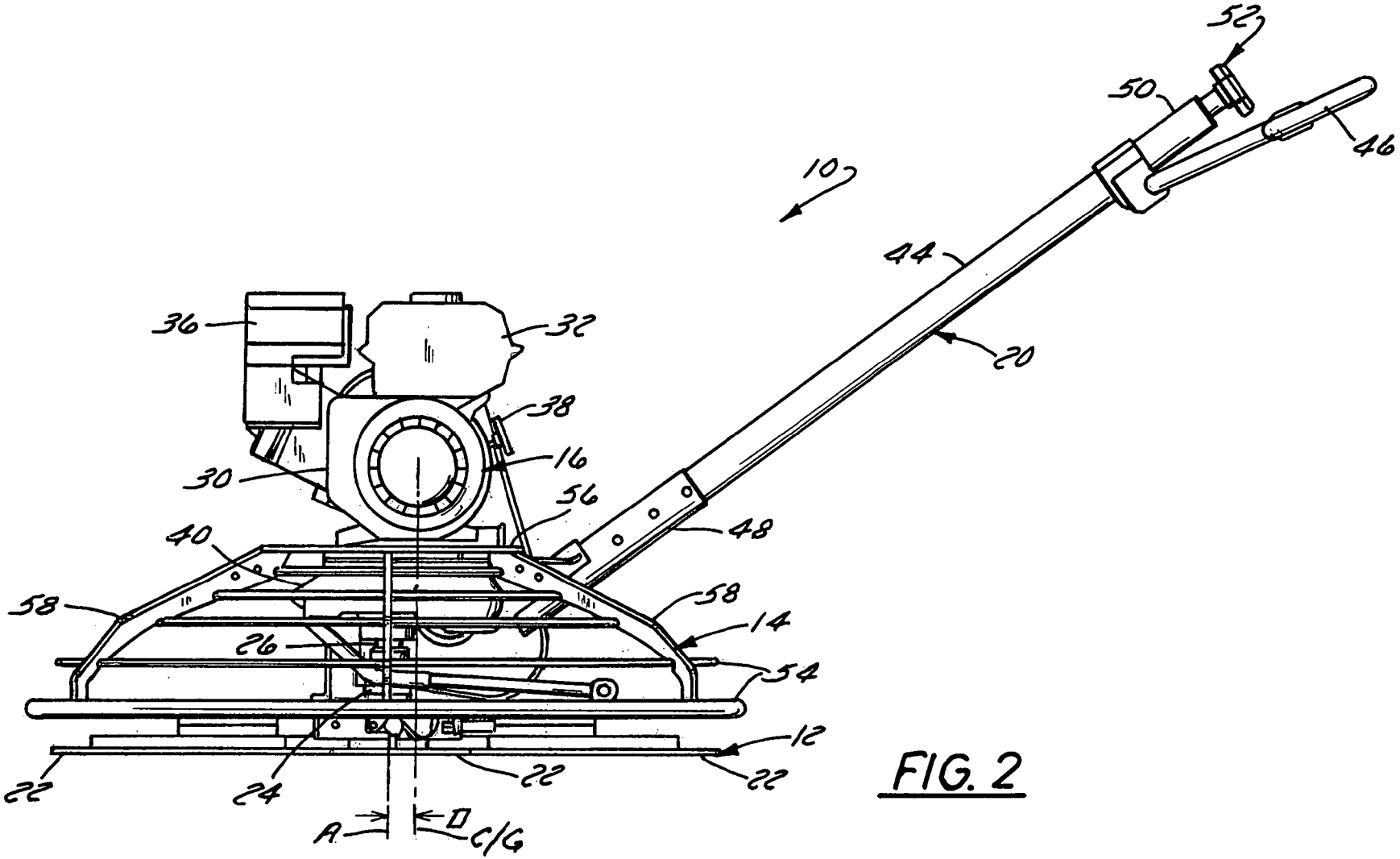
FIG. 2 is a side elevation view the trowel of FIG. 1.
Figure 3:
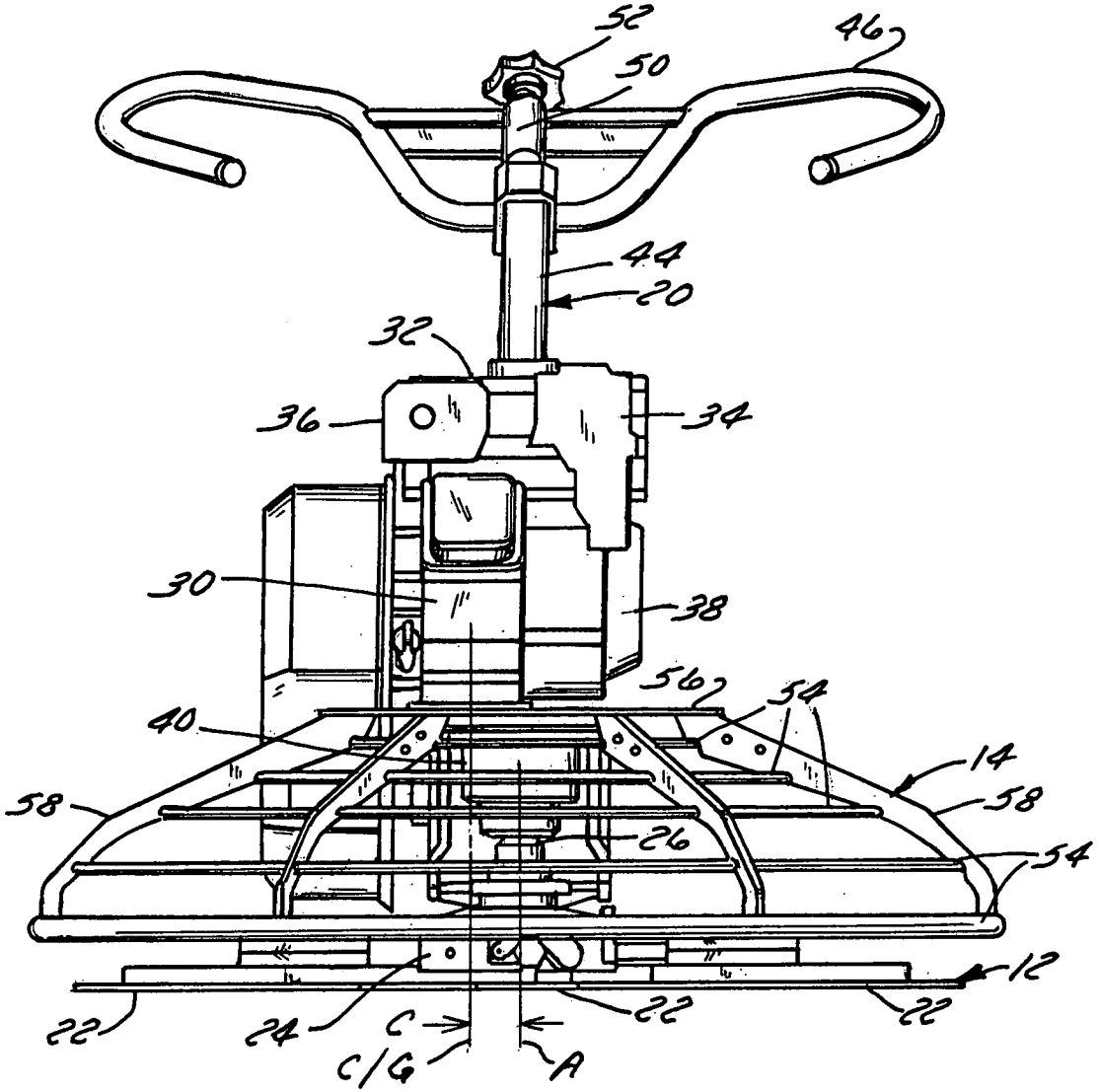
FIG. 3 is a front elevation view of the trowel of FIGS. 1 and 2.
Figure 4:
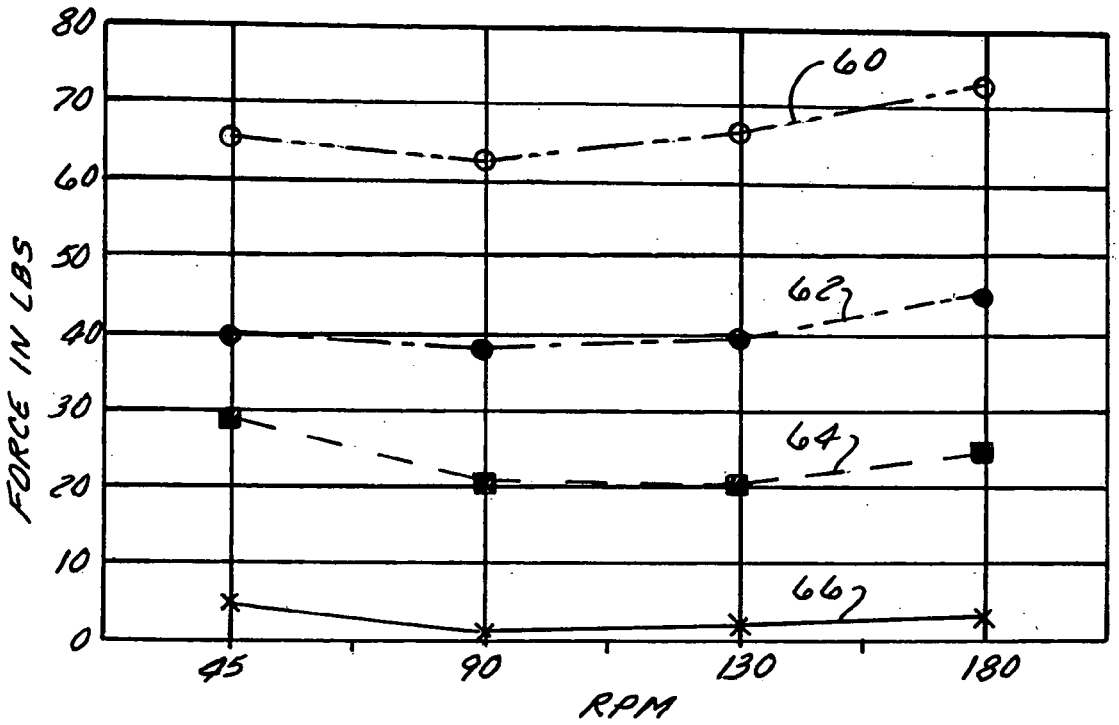
FIG. 4 is a series of graphs charting force v. RPM for a variety of operating conditions.

A walk behind trowel 10 constructed in accordance with a preferred embodiment of the invention is illustrated in FIGS. 1–3. In general, the walk behind trowel 10 includes a rotor 12, a frame or "cage" 14 that overlies and is supported on the rotor 12, an engine 16 that is supported on the cage 14, a drive train 18 operatively coupling the engine 16 to the rotor 12, and a handle 20 for controlling and steering the trowel 10. Referring to FIG. 2, the rotor 12 includes a plurality of trowel blades 22 extending radially from a hub 24 which, in turn, is driven by a vertical shaft 26.

The motor 16 comprises an internal combustion engine mounted on the cage 14 above the rotor 12. Referring again to FIGS. 1–13, the engine 16 is of the type commonly used on walk behind trowels. It therefore includes a crankcase 30, a fuel tank 32, an air supply system 34, a muffler 36, a pull-chord type starter 38, an output shaft (not shown), etc. The drive train 18 may be any structure configured to transfer drive torque from the engine output shaft to the rotor input shaft 26. In the illustrated embodiment, it comprises a centrifugal clutch (not shown) coupled to the motor output shaft and a gearbox 40 that transfers torque from the clutch to the rotor input shaft 26. The gearbox is coupled to the clutch by a belt drive assembly 42, shown schematically in FIG. 1. The preferred gearbox 40 is a worm gearbox of the type commonly used on walk behind trowels.

The handle assembly 12 includes a post 44 and a guide handle 46. The post 44 has a lower end 48 attached to the gearbox 40 and an upper end 50 disposed several feet above and behind the lower end 48. The guide handle 46 is mounted on the upper end 50 of the post 44. A blade pitch adjustment knob 52 is mounted on the upper end 50 of the post 44. Other controls, such as throttle control, a kill switch, etc., may be mounted on the post 44 and/or the guide handle 46.

The cage 14 is formed from a plurality of vertically spaced concentric rings 54 located beneath a deck 56 and interconnected by a number of angled arms 58, each of which extends downwardly from the bottom of the deck 56 to the bottommost rings 54. The rings 54 may be made from tubes, barstock, or any other structure that is suitably rigid and strong to support the trowel 10 and protect the rotor 12. In order to distribute weight in a desired manner, one or more of the rings 54 may be segmented, with one or more arcuate segment(s) being made of relatively light tubestock, other segment(s) being made of heavier barstock, and/or other segment(s) being eliminated entirely. One or more of the arm(s) 58 could be similarly segmented. Weights could also be mounted on the cage 14 at strategic locations to achieve additional strategic weight distribution.

2. Center of Gravity Offset

Still referring to FIGS. 1–3, and in accordance with the invention, the trowel's center of gravity "C/G" is offset laterally and longitudinally relative to the rotor's rotation axis "A." Specifically, the center of gravity is spaced rearwardly and to the right of the rotational axis A. The considerations behind this positioning and the optimal positions are discussed in more detail in Section 3 below. In the illustrated embodiment, practical dynamical balancing is best achieved through two effects. First, the engine 16 is rotated 180° relative to the guide handle 20 when compared to a conventional machine. Hence, the fuel tank 32 faces rearwardly, or towards the operator, and the air supply system 34 and muffler 36 face forwardly, away from the operator. In addition, the torque transfer system 18 is positioned to the operator's right as opposed to his or her left, and the pull chord 38 is positioned on the operator's left as opposed to his or her right. The engine 16 therefore can be considered "forward facing" as opposed to "rearward facing." As a result, the engine's center of gravity C/G is disposed to the right of trowel's geometric center. The gearbox 40 is also rotated 180° to accommodate the engine's reorientation. The combined effect of these reorientations is a significant shift of the machine's center of gravity C/G to the right when compared to prior machines. It also moves the center of gravity C/G to a location further behind the rotor's rotational axis A.

In the illustrated embodiment of a 48" trowel, i.e., one whose blade circumference is a 48" diameter circle, optimal results given the practical limitations of the machine design, such as guide handle length, engine mass, limitations on engine to gearbox spacing, etc., resulted when the engine 16 was shifted so as to shift or relocate the center of gravity C/G to a location 3.75 inches behind and 0.375 inches to the right of the trowel axis A. The resultant longitudinal and lateral offsets, "d" and "c", are illustrated in FIGS. 2 and 3, respectively. Of course, some of the beneficial balancing effects would result with smaller offsets, particularly smaller lateral (X) offsets, such as 0.125. Optimum offset calculations and offset interdependence are discussed in section 3 below.

This relocation has been found to nearly eliminate the linear forces acting on the guide handle 46, requiring that the operator only need to counteract the rotational torque imposed on the handle and the linear forces resulting from that torque. This effect is illustrated in the series of graphs of FIG. 5, which compare the forces and endured by an operator of a prior art 48" trowel to those imposed by a trowel constructed as described above. The forces were measured with standard blades operating on a steel sheet. A comparison of curves 60 to 64 confirm that, depending on engine RPM, total forces endured are reduced from about 65–75 lbs, to 20–30 lbs. A comparison of curves 62 and 66 reveals that linear forces, i.e., those resulting from factors other than blade torque and compensated for by offsetting the machine's center of gravity as described above, are reduced from about 40–45 lbs to less than 10 lbs.

An ancillary benefit of this engine reorientation is that it increases operator comfort because the heat and fumes from the exhaust are now directed away from the operator rather than towards the operator.

3. Center of Gravity Offset Determination

The optimal lateral and longitudinal center of gravity offsets "c" and "d" relative to the rotor's rotational axis A, i.e., the optimal center of gravity position for a given trowel design, could be determined purely empirically by trial and error. They could also be determined mathematically by taking practical considerations into account, such as machine geometry and changes in coefficient of dynamic friction experienced by the trowel during the curing concrete process, etc. These calculations will now be explained with reference to FIGS. 5A–5C, which schematically illustrate the forces generated during operation of the walk behind trowel.

Figure 5A:
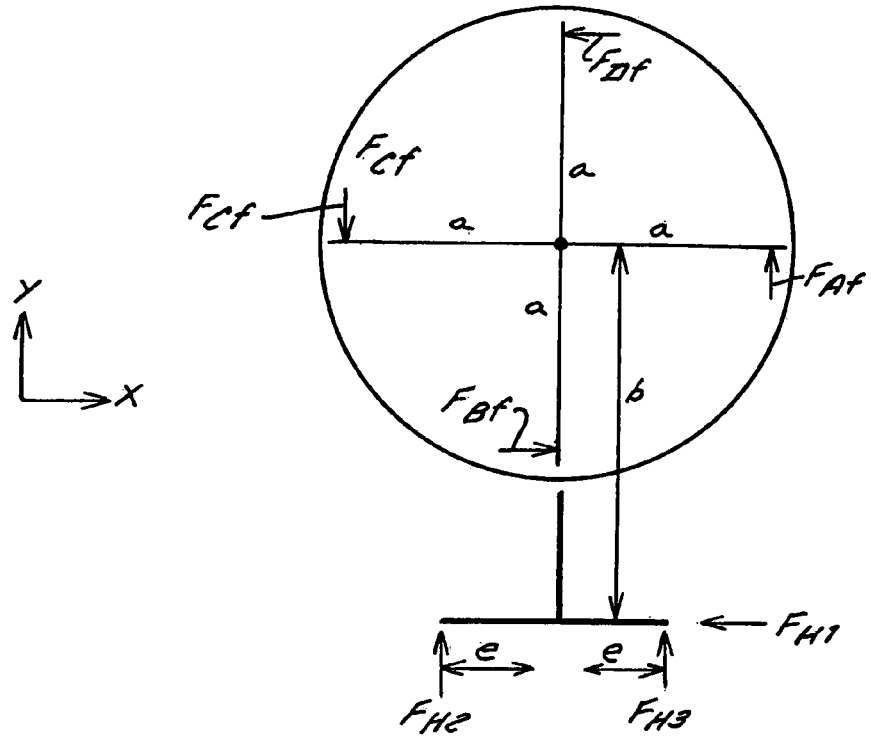
FIGS. 5A–5C are a series of force diagrams that schematically illustrate the forces generated upon operation of a walk behind trowel.

Dynamically balancing the trowel requires that as many forces acting on the handle as possible be eliminated. Referring first to FIG. 5A, which is a force diagram in the horizontal (XY) plane, the lines 70 designate the blades, it being assumed that each blade has the same effective length "a," as measured from the rotor rotational axis A to the centroid of the forces acting on the trowel blade. The line 72 designates the handle in the lateral (X) plane and has effective lengths "e" on either side of the center post 44 (FIGS. 1–3), i.e., the guide handle and has a lateral length of 2 e. The handle 12 has an effective longitudinal length "b," as measured from the rotational axis A of the rotor to the grips on the guide handle as schematically represented by the line 74. In operation, the four blades are subjected to friction-generated horizontal forces $F_{Af}$, $F_{Bf}$, $F_{Cf}$, and $F_{Df}$, respectively, which result in corresponding moment arms $aF_{Af}$, $aF_{Bf}$, $aF_{Cf}$, and $aF_{Df}$ about the rotor axis A. The handle 12 is subjected to longitudinal (Y) horizontal forces $F_{H2}$ and $F_{H3}$ and a lateral (X) force $F_{H1}$.

The forces acting on the handle in the X direction can balanced or set to zero using the equation:

$$F_{H1}+F_{Af}=F_{Bf} \quad \text{Equation 1}$$

The forces acting on the handle in the Y direction can balanced or set to zero using the equation:

$$F_{Cf}=F_{Df}+F_{H2}+F_{H3} \quad \text{Equation 2}$$

The moment in the XY plane can be balanced or set to zero using the equation:

$$a(F_{Af}+F_{Bf}+F_{Cf}+F_{Df})=bF_{H1}+eF_{H2}-eF_{H3} \quad \text{Equation 3}$$

The same procedure can be used to represent the balancing of forces in the remaining planes. Hence, referring to FIG. 5B, which represents the trowel in the XZ plane, the vertical (Z) forces acting on the handle can balanced or set to zero using the equation:

$$F_w=F_{AZ}+F_{BZ}+F_{CZ}+F_{DZ}+F_{H4}+F_{H5} \quad \text{Equation 4}$$

Where, in addition to the forces defined above:

$F_{AZ}$, $F_{BZ}$, $F_{CZ}$, and $F_{DZ}$=the vertical forces acting on the b $F_{H4}$ and $F_{H5}$=the vertical forces acting on the ends of the guide handle;

$F_w$=the gravitational force acting through the machine's center of gravity;

and c=the lateral (X) offset between the machine's center of gravity C/G and the center of the machine, which coincides with the rotor axis of rotation A.

The moment in the XZ plane can be balanced or set to zero using the equation:

$$aF_{Dz}+hF_{H1}+eF_{H5}-eF_{H4}-aF_{Cz}-cF_w=0 \quad \text{Equation 5}$$

Figure 5B:
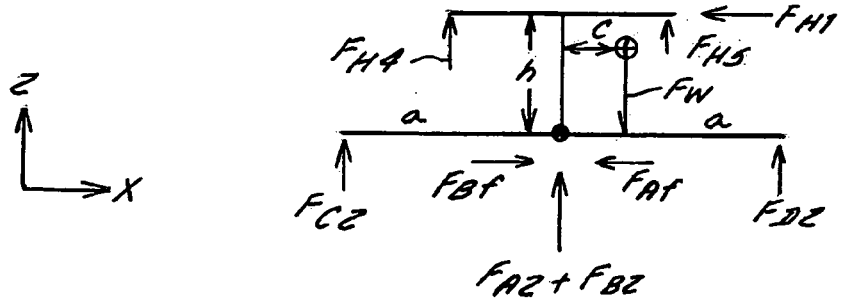

Where: h=height of the guide handle (see line 76 in FIG. 5B).

Figure 5C:
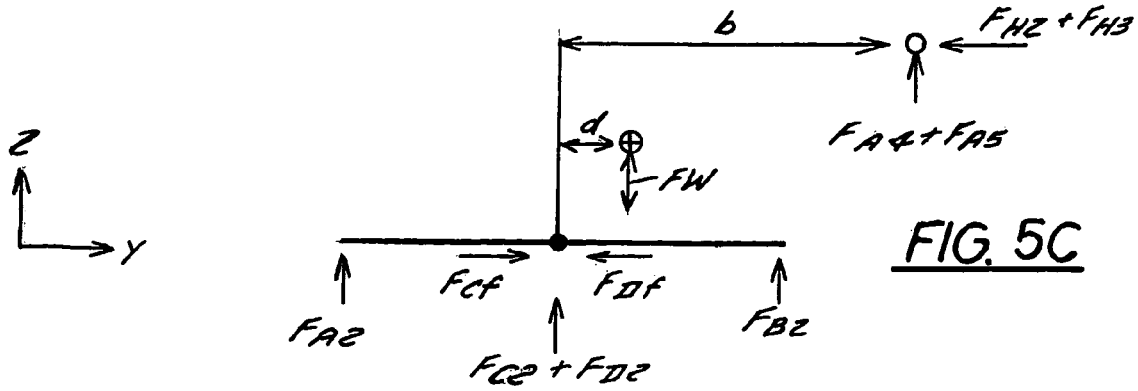

Referring to FIG. 5C, which represents the trowel in the YZ plane, the moment in the YZ plane can be balanced or set to zero using the equation:

$$aF_{AZ}+dF_w=aF_{Bz}+bF_{A4}+bF_{A5}+hF_{H2}+hF_{H3} \quad \text{Equation 6}$$

Where: d=the longitudinal (Y) offset between the machine's center of gravity C/G and the center of the machine, which coincides with the rotor axis of rotation A.

Using the above parameters, the side-to-side center of gravity, c, as a function of forces on the handle, the trowel dimensions, and the coefficient of friction, $\mu$, of the surface to be finished, can be expressed as:

$$\frac{hF_{H1}+e(F_{H5}-F_{H4})-\left[\frac{bF_{H1}+e(F_{H2}-F_{H3})}{\mu^2(F_w-F_{H4}-F_{H5})}\right](F_{H2}+F_{H3})}{F_w}=c \quad \text{Equation 7}$$

The force $F_{H1}$ results for torque imposed by blade rotation and cannot be eliminated by adjusting the trowel's center of gravity. However, by simplifying equation 7 to set the remaining forces $F_{H2}$, $F_{H3}$, $F_{H4}$, and $F_{H5}$ to zero, the lateral offset, c, required to eliminate those forces can be determined by the equation:

$$c=\frac{ha\mu}{b} \quad \text{Equation 8}$$

Similarly, the front-to-rear center of gravity, d, as a function of forces imposed on the handle, the trowel dimensions, and the finished surface coefficient of friction, $\mu$, can be expressed as:

$$d=\frac{\frac{bF_{H1}^2+eF_{H1}(F_{H2}-F_{H3})}{\mu^2(F_w-F_{H4}-F_{H5})}+b(F_{H4}+F_{H5})+h(F_{H2}+F_{H3})}{F_w} \quad \text{Equation 9}$$

By simplifying equation 9 to set the forces $F_{H2}$, $F_{H3}$, $F_{H4}$, and $F_{H5}$ to zero, Equation 9 can be solved for d using the equation:

$$d=\frac{a^2}{b} \quad \text{Equation 10}$$

Hence, a machine configured to have a center of gravity C/G that is laterally and longitudinally offset from the center of the machine (as determined by the rotor's axis of rotation A) by values c and d as determined using equations 8 and 10 would theoretically impose no non-torque induced forces on the handle during trowel operation.

The theoretical values of c and d are not practical for most existing walk-behind trowel configurations and might not even be possible for some trowels. For instance, the theoretical best lateral offset c might be spaced so far from the rotor rotational axis A that the engine would have to be cantilevered off the side of the machine.

As such, it is necessary as a practical matter to determine the effects that c and d have on each other over a range of offsets and to select practical values of c and d that best achieve the desired goal of dynamic balancing. This can be done using the followings steps:

First, to simplify the calculations by discounting the least problematic forces to the extent that they are minimal and/or relatively unlikely to occur, it can be assumed that no twisting forces are imposed on the guide handle 46 (i.e., $F_{H4}=F_{H5}$) and that $F_{H3}=0$ due to the fact that the operator typically pushes on the handle with only the left hand to be counteract the torque imposed by the clockwise rotating blades. The combined force $F_{23}$ (resulting from the combination of the longitudinal forces $F_{H2}$ and $F_{H3}$) can be determined for each of a number of practical longitudinal offsets d using the following equation:

$$F_{23}=\frac{dF_w-\frac{a^2}{b}(F_w-F_{45})-bF_{45}}{\left(h-\frac{ea}{b\mu}\right)} \quad \text{Equation 11}$$

Second, the combined force $F_{45}$ (resulting from the combination of the vertical forces $F_{H4}$ and $F_{H5}$) can be determined for each of a number of practical longitudinal offsets d and practical lateral offsets c using the following equation:

$$F_{45}=F_w\frac{(\mu b^2hc-ceab-h^2a\mu^2b+hea^2\mu+ehb\mu d-eh\mu a^2+ab^2d-a^3b)}{(-h^2a\mu^2+hea^2\mu-eh\mu a^2+ehb^2\mu-a^3b+ab^3)} \quad \text{Equation 12}$$

A table can then be generated that permits the designer to select the offsets c and d that strike the best balance between $F_{23}$ and $F_{45}$. Of course, the designer may choose to place priority on one of these values, for instance by selecting an offset that reduces $F_{45}$ as much as practical while sacrificing some reduction in $F_{23}$.

The effects of this analysis and its practical implementation can be appreciated from Table 1, which relays traditional typical (prior art) offsets, theoretical offsets, and practical offsets as selected using the procedure described immediately above for both a 36" trowel and a 48" trowel, where positive values indicate locations behind or to the right of the rotor axis A and negative values indicate locations ahead or to left of the rotor axis A. Note that the terms "36 inch trowel" and "48 inch trowel" are accepted terms of art designating standard trowel sizes rather than designating any particular precise trowel dimension. Note also that a few manufacturers refer to what is more commonly known as a "48 inch trowel" as a "46 inch trowel."

TABLE 1

| Typical Offsets | | |
|---|---|---|
| | 36" Trowel | 48" Trowel |
| Standard x offset | −0.375" | −0.125 |
| Standard y offset | 3.25" | 2.50" |
| Theoretical x offset | 3.46" | 3.88" |
| Theoretical y offset | 1.59" | 2.38" |
| Typical practical x offset | 0.75" | 0.375" |
| Typical practical y offset | 3.875" | 3.75" |

4. Operation of Trowel

During normal operation of the trowel 10, torque is transferred from the engine's output shaft, to the clutch, the drive train, the gearbox 40, and the rotor.

The blades 22 are thereupon driven to rotate and contact with the surface to be finished, smoothing the concrete. The frictional resistance imposed by the concrete varies, e.g., with the rotor rotation or velocity, the types of blades or pans used to finish the surface and the orientation of the blades or pan relative to the surface, and the coefficient of friction of the surface. The operator guides the machine 10 along the surface during this operation using the guide handle. In prior walk behind trowels, this operation would be resisted by substantial forces totaling 60–75 lbs. However, because the trowel 10 is dynamically balanced as described above, the total forces endured by the operator to 20–30 lbs., a reduction of well over 50%.As indicated above, many changes and modifications may be made to the present invention without departing from the spirit thereof. The scope of some of these changes is discussed above. The scope of others will become apparent from the appended claims.

What is claimed is:

1. A concrete finishing trowel comprising:

(A) a frame;

(B) a motor that is mounted on said frame and that has a rotatable output;

(C) an operator controlled guide handle that that extends rearwardly from the frame along a line that at least generally laterally bisects said frame; and;

(D) a rotor that includes a plurality of blades which are rotatable about a downwardly extending rotational axis that is located on said line and that is at least approximately centered on the frame, wherein said trowel is dynamically balanced such that forces transmitted to the handle upon rotation of the blades in contact with a surface to be finished are substantially reduced when compared to a non-dynamically balanced trowel, wherein said trowel has a center of gravity that is offset longitudinally behind the rotational axis of the rotor and laterally to the right of said line when viewed from behind the trowel.

2. The trowel as recited in claim 1, wherein the trowel is a 36" trowel, and the trowel's center of gravity is located between 0.00" and 2.00" to right of the rotational axis of the rotor.

3. The trowel as recited in claim 2, and wherein the trowel's center of gravity is located between 2.00" and 4.50" behind the rotational axis of the rotor.

4. The trowel as recited in claim 3, wherein the trowel's center of gravity is located about 0.75" to the right and about 3.875" behind the rotational axis of the rotor.

5. The trowel as recited in claim 1, wherein the trowel is a 48" trowel, and wherein the trowel's center of gravity is located between 0.00" and 1.50" to the right of the rotational axis of the rotor.

6. The trowel as recited in claim 5, wherein the trowel's center of gravity is located between 2.00" and 4.50" behind the rotational axis of the rotor.

7. The trowel as recited in claim 6, wherein the trowel's center of gravity is located about 0.3 75" to the right and about 3.750" behind the rotational axis of the rotor.

8. The trowel as recited in claim 1, wherein the longitudinal and lateral offsets are selected in dependence on one another.

9. The trowel as recited in claim 1, wherein the lateral and longitudinal offsets are determined taking guide handle length and position and typical torque-generated forces into account.

10. The trowel as recited in claim 9, wherein the lateral and longitudinal offsets are determined taking finished surface coefficient of friction into account.

11. The trowel as recited in claim 1, wherein the longitudinal offset is determined taking the following equation into account.

$$d = \frac{a^2}{b}$$

Where:

d=the longitudinal offset;

a=the length of a horizontal line connecting the rotational axis of the rotor to the centroid of the forces acting on one of the trowel blades, "a" being assumed to be the same for each trowel blade; and b=the longitudinal distance between the rotational axis of the trowel and the guide handle.

12. The trowel as recited in claim 1, wherein the lateral offset is determined taking the following equation into account.

$$c = \frac{ha\mu}{b}$$

where:

c=the lateral offset;

h=the height of the guide handle;

a=the length of a horizontal line connecting the rotational axis of the rotor to the centroid of the forces acting on one of the trowel blades, "a" being assumed to be the same for each trowel blade;

$\mu$=the dynamic coefficient of friction of the finished surface; and b=the longitudinal distance between the rotational axis of the trowel and the guide handle.

13. The trowel as recited in claim 1, wherein, during a concrete finishing operation, the trowel is configured to impose an average rearward force on the guide handle of no more than 50 lbs.

14. The trowel as recited in claim 13, wherein, during a concrete finishing operation, the trowel is configured to impose an average rearward force on the guide handle of no more than 30 lbs.

15. A concrete finishing trowel comprising:

(A) a frame;

(B) a motor that is mounted on said frame;

(C) an-operator controlled guide handle that that extends rearwardly from the frame along a line that at least generally laterally bisects said frame; and;

(D) a rotor that includes a plurality of blades which are rotatable about a downwardly extending rotational axis that is located on said line and that is at least approximately centered on the frame, wherein said trowel has a center of gravity that is offset longitudinally behind the rotational axis of the rotor and laterally to the right of said line.

16. A concrete finishing trowel composing:

(A) a frame;

(B) a motor that is mounted on said frame and that has a rotatable output;

(C) an operator controlled guide handle that that extends rearwardly from the frame along a line that at least generally laterally bisects said frame; and (D) a rotor that includes a plurality of blades which are rotatable about a downwardly extending rotational axis that is located on said line and that is at least approximately centered on the frame, wherein said trowel is dynamically balanced such that forces transmitted to the handle upon rotation of the blades in contact with a surface to be finished are substantially reduced when compared to a non-dynamically balanced trowel, wherein said trowel has a center of gravity that is offset longitudinally behind the rotational axis of the rotor and laterally to the .right of said line when viewed from behind the trowel, and wherein said motor has an output shaft facing to the right of said trowel when viewed from behind the trowel and a muffler facing forwardly of said trowel.

17. The trowel as recited in claim 16, wherein the longitudinal and lateral offsets are selected based at least in part on at least one of the following equations:

$$F_{23} = \frac{dF_w - \frac{a^2}{b}(F_w - F_{45}) - bF_{45}}{\left(h - \frac{ea}{b\mu}\right)}$$

where:

$F_{23}$=the combined longitudinal forces imposed on the guide handle;

d =the longitudinal offset;

$F_w$=the gravitational force through the center of gravity of the trowel;

a=the length of a horizontal line connecting the rotational axis of the rotor to the centroid of the forces acting on one of the trowel blades, "a" being assumed to be the same for each trowel blade;

b=the longitudinal distance between the rotational axis of the trowel and the guide handle;

$F_{45}$=the combined vertical forces imposed on the guide handle;

h=the height of the guide handle;

e=½ the lateral length of the guide handle;

$\mu$=the dynamic coefficient of friction of the finished surface; and $$F_{45} = F_w \frac{(\mu b^2 hc - ceab - h^2 a\mu^2 b + hea^2\mu + ehb\mu d - eh\mu a^2 + ab^2 d - a^3 b)}{(-h^2 a\mu^2 + hea^2\mu - eh\mu a^2 + ehb^2\mu - a^3 b + ab^3)}$$

where:

c=the lateral offset.

18. A concrete finishing trowel comprising:

(A) a frame;

(B) a motor that is mounted on said frame;

(C) an-operator controlled guide handle that that extends rearwardly from the frame along a line that at least generally laterally bisects said frame; and (D) a rotor that includes a plurality of blades which are rotatable about a downwardly extending rotational axis that is located on said line is and that is at least approximately centered on the frame, wherein said trowel has a center of gravity that is offset longitudinally behind and laterally to the right of the rotational axis of the rotor when viewed from behind the trowel, wherein said motor has an output shaft facing to the right of said trowel when viewed from behind the trowel and a muffler facing forwardly of said trowel.

* * * * *

UNITED STATES PATENT AND TRADEMARK OFFICE

CERTIFICATE OF CORRECTION

PATENT NO. : 6,974,277 B2
DATED : December 13, 2005
INVENTOR(S) : Todd J. Lutz et al.

It is certified that error appears in the above-identified patent and that said Letters Patent is hereby corrected as shown below:

Column 7,
Line 59, replace “that that” with -- that --.
Line 61, delete “;” after “and”.

Column 8,
Line 25, replace “0.3 75”” with -- 0.375” --.

Column 9,
Lines 20 and 35, replace “that that” with -- that --.
Line 22, delete “;” after “and”.
Line 48, delete “.” preceeding “right”.

Column 10,
Line 41, replace “that that” with -- that --.
Line 46, replace “line is and” with -- line and --.

Signed and Sealed this

Fourteenth Day of February, 2006

JON W. DUDAS
*Director of the United States Patent and Trademark Office*